US011565538B2

(12) United States Patent
Kanda et al.

(10) Patent No.: US 11,565,538 B2
(45) Date of Patent: Jan. 31, 2023

(54) PRINTER CAPABLE OF SETTING TO FORCIBLE DISCHARGE MODE FOR FORCIBLY EXPELLING PRINTED MEDIUM PIECE OUT OF PRINTER CASING

(71) Applicant: BROTHER KOGYO KABUSHIKI KAISHA, Nagoya (JP)

(72) Inventors: Ryuichi Kanda, Nagoya (JP); Kentaro Murayama, Kasugai (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/534,036

(22) Filed: Nov. 23, 2021

(65) Prior Publication Data

US 2022/0169050 A1 Jun. 2, 2022

(30) Foreign Application Priority Data

Nov. 30, 2020 (JP) ..... JP2020-198309

(51) Int. Cl.

| | |
|---|---|
| ***B41J 11/66*** | (2006.01) |
| ***B41J 3/407*** | (2006.01) |
| ***B41J 15/04*** | (2006.01) |
| ***B41J 13/00*** | (2006.01) |

(52) U.S. Cl.

CPC ..... *B41J 11/663* (2013.01); *B41J 13/0045* (2013.01)

(58) Field of Classification Search

CPC . B41J 11/66; B41J 3/4075; B41J 15/00; B41J 15/042; B41J 15/044

See application file for complete search history.

(56) References Cited

U.S. PATENT DOCUMENTS

2017/0368849 A1* 12/2017 Masunaga ..... B41J 11/005

FOREIGN PATENT DOCUMENTS

| | | | | |
|---|---|---|---|---|
| JP | 2002-144657 A | | 5/2002 | |
| JP | 2004-306304 A | | 11/2004 | |
| JP | 2006-327080 A | | 12/2006 | |
| JP | 2022057717 A | * | 4/2022 | ..... B41J 11/007 |

OTHER PUBLICATIONS

Kamio,MachineTranslationofJP-2022057717-A, 2022 (Year: 2022).*

* cited by examiner

*Primary Examiner* — Scott A Richmond

(74) *Attorney, Agent, or Firm* — Kenealy Vaidya LLP

(57) ABSTRACT

A printer includes a printing unit, a conveying unit, a cutting unit, a casing and a controller. The controller is configured to perform receiving a setting for a discharge mode of a printed medium piece. The controller is configured to further perform, in a case where the discharge mode is currently set to a forcible discharge mode, forcibly discharging the printed medium piece from the casing through the discharging opening, a leading edge of a continuous printing medium being conveyed by a first feed amount in the conveying direction by driving the conveying unit such that the printed medium piece is pushed by the leading edge of the continuous printing medium. The controller is configured to further perform, in a case where the discharge mode is currently set to a non-forcible discharge mode, non-forcibly discharging the printed medium piece from the casing.

8 Claims, 8 Drawing Sheets

UP
FRONT
REAR
DOWN 3
81
11
31
M
12
10
D
64
6
61
5
8
82
1
83
35
Q
6
M
64
61
31
10
5
D
32
4
2
3
R
5
8
83

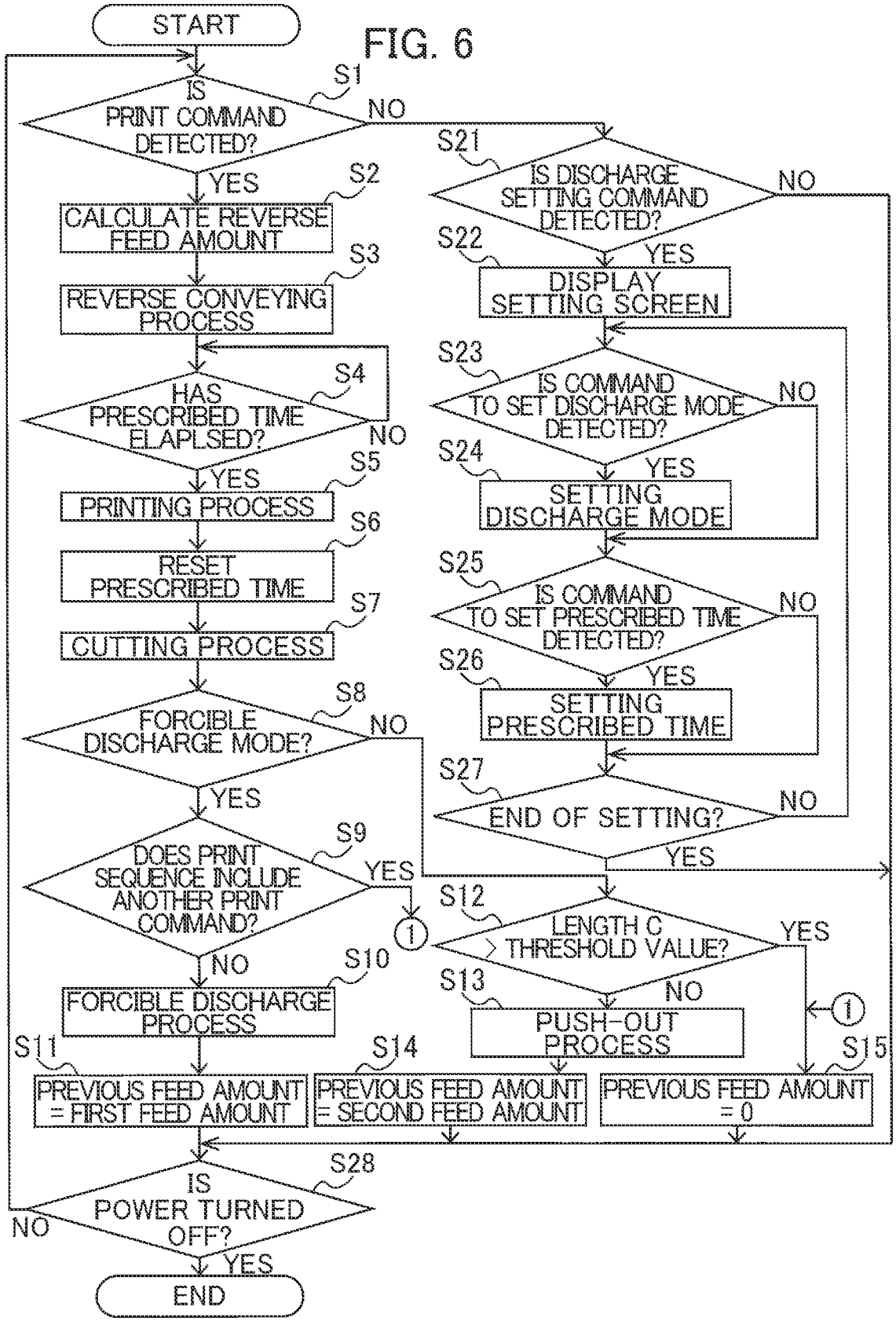
FIG. 6
START
S1
IS PRINT COMMAND DETECTED?
NO
YES
S2
CALCULATE REVERSE FEED AMOUNT
S3
REVERSE CONVEYING PROCESS
S4
HAS PRESCRIBED TIME ELAPLSED?
NO
YES
S5
PRINTING PROCESS
S6
RESET PRESCRIBED TIME
S7
CUTTING PROCESS
S8
FORCIBLE DISCHARGE MODE?
NO
YES
S9
DOES PRINT SEQUENCE INCLUDE ANOTHER PRINT COMMAND?
YES
NO
S10
FORCIBLE DISCHARGE PROCESS
S21
IS DISCHARGE SETTING COMMAND DETECTED?
NO
YES
S22
DISPLAY SETTING SCREEN
S23
IS COMMAND TO SET DISCHARGE MODE DETECTED?
NO
YES
S24
SETTING DISCHARGE MODE
S25
IS COMMAND TO SET PRESCRIBED TIME DETECTED?
NO
YES
S26
SETTING PRESCRIBED TIME
S27
END OF SETTING?
NO
YES
S12
LENGTH C > THRESHOLD VALUE?
YES
NO
S13
PUSH-OUT PROCESS
1
1
S11
PREVIOUS FEED AMOUNT = FIRST FEED AMOUNT
S14
PREVIOUS FEED AMOUNT = SECOND FEED AMOUNT
S15
PREVIOUS FEED AMOUNT = 0
S28
IS POWER TURNED OFF?
NO
YES
END

UP
FRONT
REAR
DOWN 3
31
81
6
61
M
10
5
Q
B3
B2
B1
M1
P1
82
8
R
12
14
D2
P2
D1

PRINTER CAPABLE OF SETTING TO FORCIBLE DISCHARGE MODE FOR FORCIBLY EXPELLING PRINTED MEDIUM PIECE OUT OF PRINTER CASING

CROSS REFERENCE TO RELATED APPLICATION

This application claims priority from Japanese Patent Application No. 2020-198309 filed Nov. 30, 2020. The entire content of the priority application is incorporated herein by reference.

BACKGROUND

A conventional image-recording device conveys a continuous recording sheet while recording an image thereon and subsequently operates a cutting device to cut off the section of the recording sheet on which the image was recorded (see Japanese Patent Application Publication No. 2004-306304, for example). The cut section of the recording sheet is dropped through a discharge unit into a stacker to be stacked with other recorded sections of the recording sheet. In the conventional technology of the Japanese Patent Application Publication No. 2004-306304, the image recording device continues to feed the continuous recording sheet that remains inside the image-recording device after the recorded section has been cut. This additional feed is performed to assist in ejecting the cut section in case the cut section did not drop into the stacker but remains in the discharge unit.

SUMMARY

Thus, the conventional printer (the image-recording device) always forces the printed piece of the printing medium (the cut section of the recording sheet) out of the printer's case through a discharge opening. However, in some cases the user may wish to keep the printed piece of printing medium in the discharge opening.

In view of the foregoing, it is an object of the present invention to provide a printer that improves user-friendliness of the conventional technology with respect to the manner in which printed pieces of printing media are handled.

In order to attain the above and other objects, according to one aspect, the disclosure provides a printer including a printing unit, a conveying unit, a cutting unit, a casing and a controller. The printing unit is configured to print images on a continuous printing medium. The conveying unit is configured to convey the continuous printing medium in a conveying direction. The cutting unit is positioned downstream of the printing unit in the conveying direction. The cutting unit is configured to cut off a printed medium piece from the continuous printing medium. The casing is configured to accommodate the printing unit, the conveying unit and the cutting unit therein. The casing is formed with a discharging opening. The controller is configured to control the printing unit, the conveying unit and the cutting unit. The controller is configured to perform receiving a setting for a discharge mode of the printed medium piece, the setting being selected from among a plurality of modes which includes a forcible discharge mode and a non-forcible discharge mode. The controller is configured to further perform driving the printing unit to print an image on the continuous printing medium in response to a print command. The controller is configured to further perform driving the cutting unit to cut off the printed medium piece from the continuous printing medium after completing the printing in response to the print command. The controller is configured to further perform, in a case where the discharge mode is currently set to the forcible discharge mode, after completing the cutting in response to the print command and prior to performing the printing in response to a next print command, forcibly discharging the printed medium piece from the casing through the discharging opening, a leading edge of the continuous printing medium being conveyed by a first feed amount in the conveying direction by driving the conveying unit such that the printed medium piece is pushed by the leading edge of the continuous printing medium. The controller is configured to further perform, in a case where the discharge mode is currently set to the non-forcible discharge mode, non-forcibly discharging the printed medium piece from the casing through the discharging opening.

According to this configuration, the controller can switch between executing or not executing the forcible discharge process based on the currently set discharge mode. Therefore, the printer can make retrieving the printed medium piece more user-friendly than a conventional printer, which cannot set an option for conveying or not conveying a printing medium in a conveying direction to push a printed medium piece out of a case through a discharging opening.

BRIEF DESCRIPTION OF TIE DRAWINGS

The particular features and advantages of the disclosure will become apparent from the following description taken in connection with the accompanying drawings, in which:

FIG. 6 is a flowchart illustrating a main process;

Figures 7A, 7B, 7C, 7D:
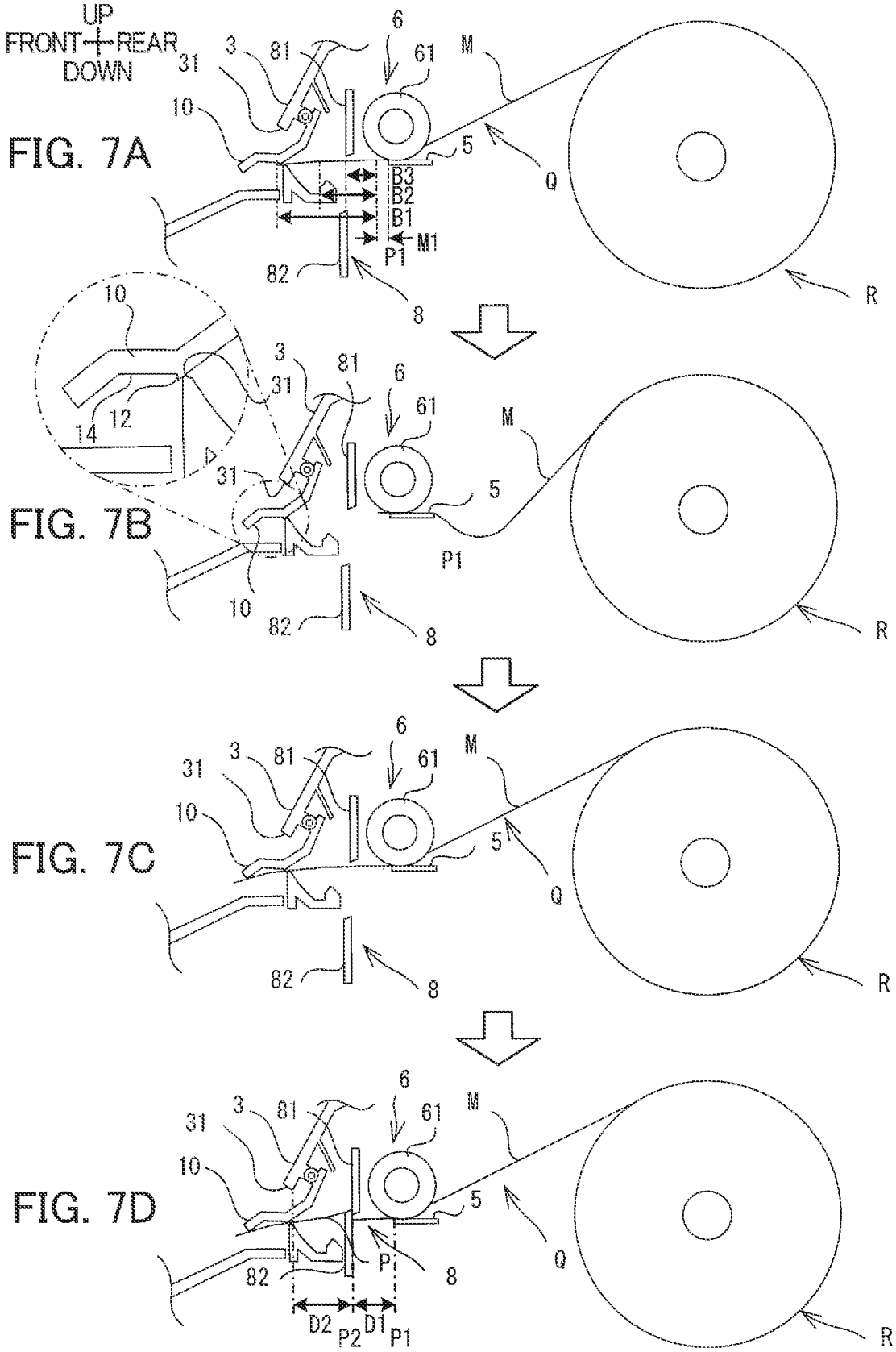
FIG. 7A is a view for description of transition of positional relationship among a leading edge of a printing medium, a printed medium piece, a platen roller, a printing unit, a cutting unit, and a discharging slot.
FIG. 7B is a view for description of transition of positional relationship among the leading edge of the printing medium, the printed medium piece, the platen roller, the printing unit, the cutting unit, and the discharging slot, in a case where the printing medium has been conveyed in a reverse conveying direction by a reverse feed amount.
FIG. 7C is a view for description of transition of positional relationship among the leading edge of the printing medium, the printed medium piece, the platen roller, the printing unit, the cutting unit, and the discharging slot, in a case where printing process has been executed in response to one print command.
FIG. 7D is a view for description of transition of positional relationship among the leading edge of the printing medium, the printed medium piece, the platen roller, the printing unit, the cutting unit, and the discharging slot, in a case where the printing medium has been cut into the printed medium piece.
Figure 7E:
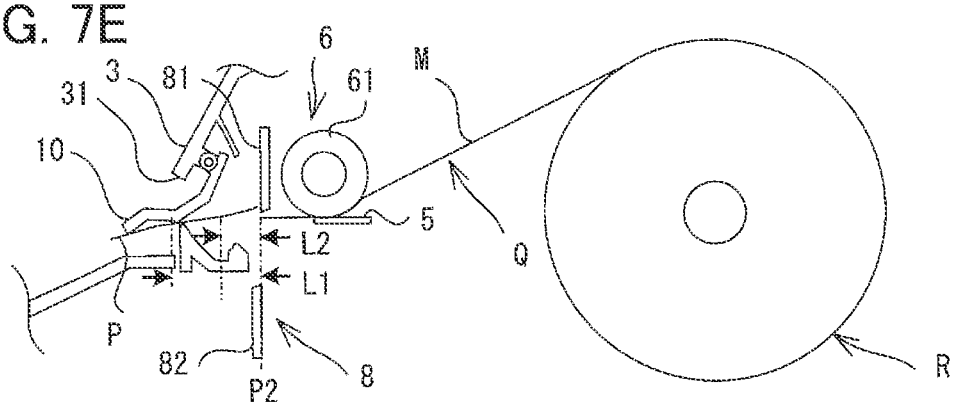
FIG. 7E is a view for description of transition of positional relationship among the leading edge of the printing medium, the printed medium piece, the platen roller, the printing unit, the cutting unit, and the discharging slot, in the where the printing medium has been cut into the printed medium piece.
Figure 7F:
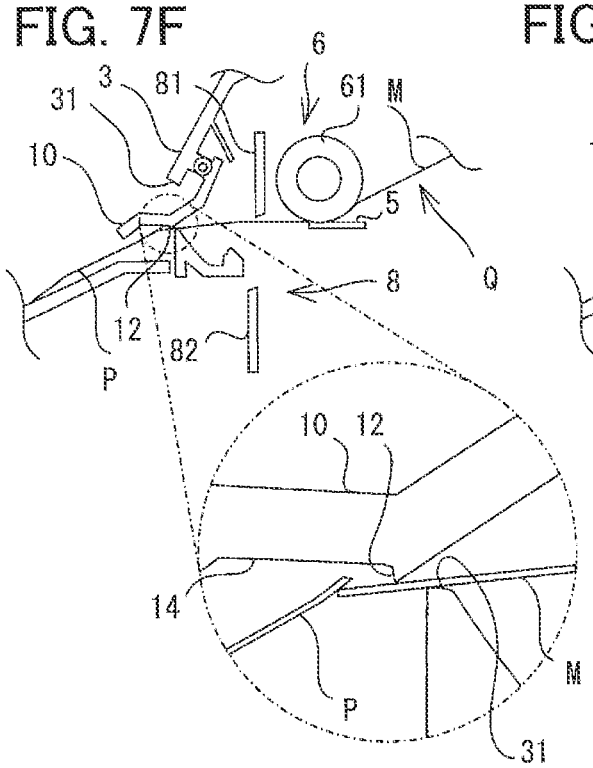
Figure 7G:
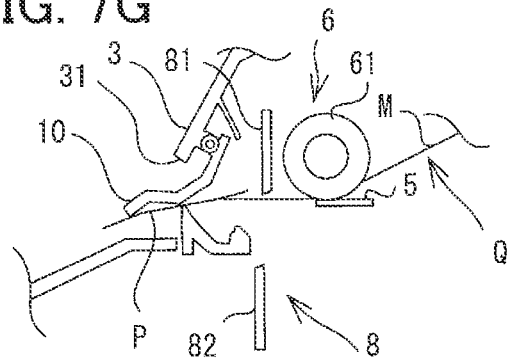

FIG. 7F is a view for description of transition of positional relationship among the leading edge of the printing medium, the printed medium piece, the platen roller, the printing unit, the cutting unit, and the discharging slot, in a case of having been executed a forcible discharging process; and FIG. 7G is a view for description of transition of positional relationship among the leading edge of the printing medium, the printed medium piece, the platen roller, the printing unit, the cutting unit, and the discharging slot, in a case of having been executed a push-out process.

DETAILED DESCRIPTION

A printer 1 according to a present embodiment of the present invention will be described while referring to the accompanying drawings. The printer 1 is a thermal label printer that prints on a printing medium M. The printing medium M is a continuous thermal paper. Below, left/right, front/rear, and top/bottom indicated in the drawings by arrows will be used to describe the left/right, front/rear, and top/bottom of the printer 1.

Figure 1:
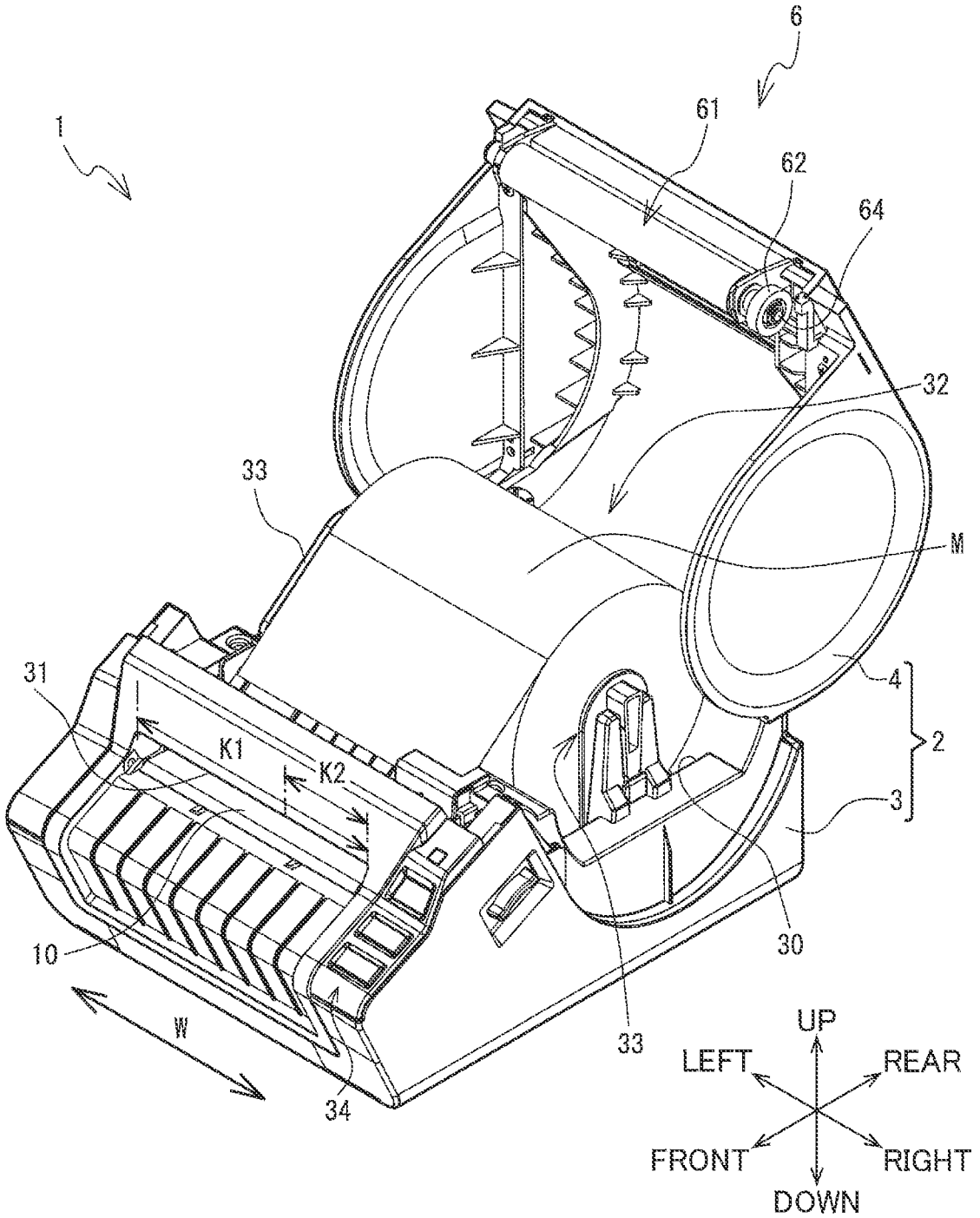
FIG. 1 is a perspective view of a printer, in a case where a cover is in an open position.
Figure 2:
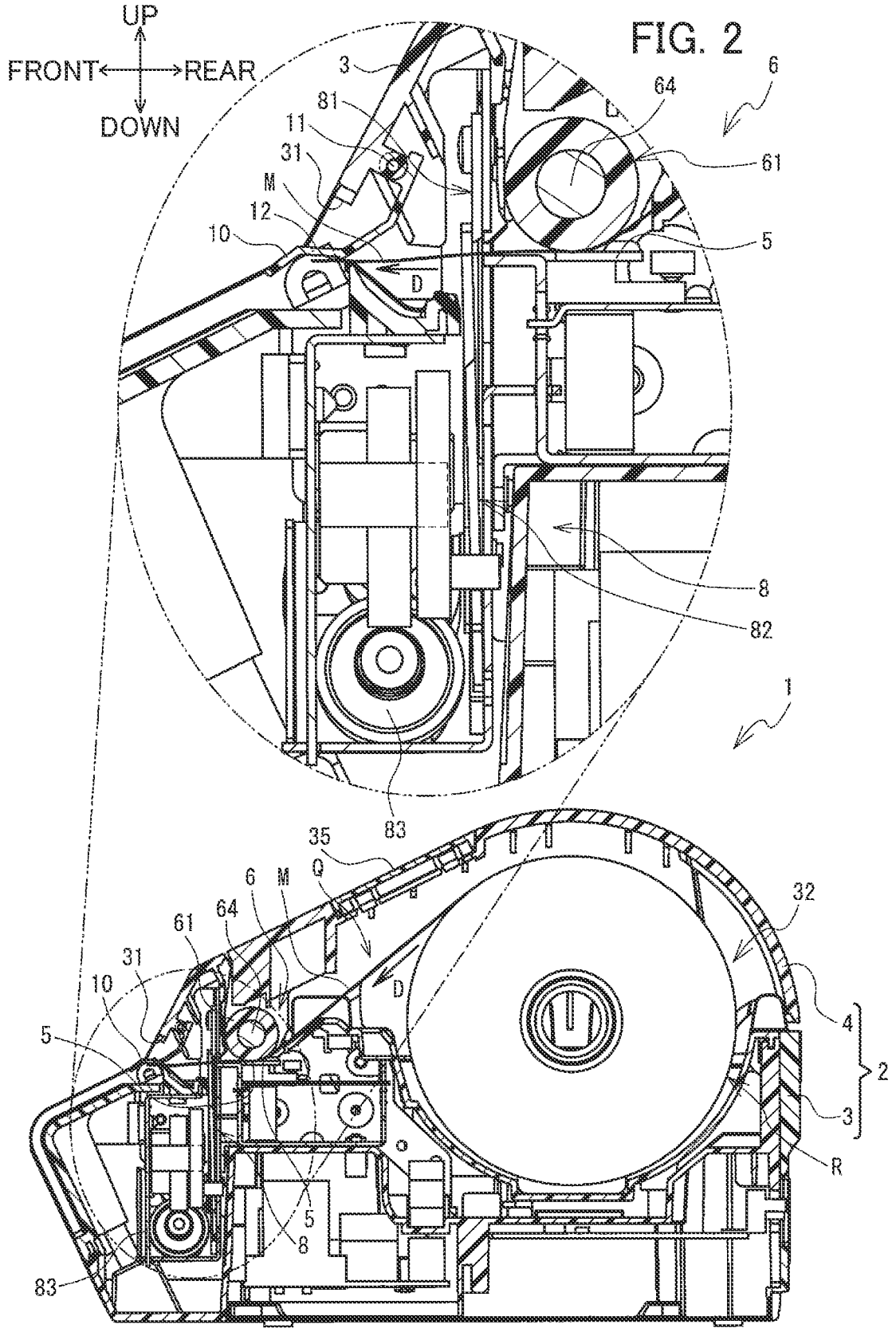
FIG. 2 is a cross-sectional view illustrating an internal structure of the printer, in a case where the cover is in a closed position.

The physical structure of the printer 1 will be described next with reference to FIGS. 1 and 2. As shown in FIGS. 1 and 2, the printer 1 is provided with a case 2, a printing unit 5, a conveying unit 6, a cutting unit 8, and a guide member 10. The case 2 accommodates the printing unit 5, conveying unit 6, and cutting unit 8. The case 2 includes a main case 3, and a cover 4. The main case 3 has a box-like shape in which an opening 30 and a discharge slot 31 are formed. The main case 3 is also provided with an accommodating section 32, a pair of left and right retaining parts 33, and an operating unit 34. The opening 30 is formed in the top of the rear portion of the main case 3 and has a rectangular shape in a plan view. The discharge slot 31 is formed in the front surface of the main case 3 and has a rectangular shape that is elongated in the left-right direction. The accommodating section 32 is a recessed part provided in the rear portion of the main case 3 that is recessed downward from the opening 30 formed in the main case 3. The accommodating section 32 accommodates a roll R configured of the printing medium M wound into a roll shape. The left and right retaining parts 33 are plate-like members provided in the accommodating section 32 on respective left and right sides of the roll R. The retaining parts 33 extend vertically and rotatably support the roll R. A width direction W of the printing medium M is equivalent to the left-right direction when the roll R is supported by the pair of retaining parts 33. The operating unit 34 is provided to the right of the discharge slot 31. The operating unit 34 includes a power button and the like and can input various information into the printer 1. The cover 4 has a rectangular shape in a plan view. The cover 4 is rotatably supported on the rear edge of the main case 3 so as to be capable of rotating around a shaft (not shown) extending in the left-right direction. The cover 4 can rotate between a closed position (see FIG. 2) for covering the accommodating section 32, and an open position (see FIG. 1) for exposing the accommodating section 32. The printer 1 is also provided with a display unit 35. The display unit 35 is positioned on the top surface of the cover 4 when the cover 4 is in the closed position. The display unit 35 can display various information.

The printing unit 5 is disposed forward of the accommodating section 32 and rearward of the discharge slot 31 formed in the main case 3. The printing unit 5 prints images on the continuous printing medium M. In the present embodiment, the printing unit 5 is a thermal head and includes a plurality of heating elements (not shown). The conveying unit 6 conveys the printing medium M in a conveying direction D. The conveying unit 6 is provided with a platen roller 61, a shaft 64, a roller gear 62, a transmission mechanism (not shown), and a conveying motor 63. The platen roller 61 is a cylindrically shaped member that extends in the left-right direction. The platen roller 61 is rotatably supported on the bottom surface of the cover 4 at the front edge thereof. The platen roller 61 is rotatable about the shaft 64, which is oriented in the left-right direction. The platen roller 61 opposes the printing unit 5 and can move vertically as the cover 4 is opened and closed. When the cover 4 is in the closed position, the platen roller 61 is pressed against the printing unit 5 with the printing medium M interposed therebetween. When the cover 4 is in the open position, the platen roller 61 is separated above the printing unit 5. The roller gear 62 is fixed to the right end of the shaft 64 in the platen roller 61. The transmission mechanism and the conveying motor 63 are provided inside the main case 3. The transmission mechanism includes a plurality of gears that transmit the drive force of the conveying motor 63 to the roller gear 62. The conveying motor 63 is a stepping motor capable of forward and reverse rotation, for example. When the cover 4 is in the closed position, the platen roller 61 of the conveying unit 6 presses the printing unit 5 downward. At this time, the roller gear 62 is engaged with a gear in the transmission mechanism and is coupled to the conveying motor 63 via the transmission mechanism. When the cover 4 is in the closed position, the drive of the conveying motor 63 rotates the platen roller 61, and the platen roller 61 conveys the printing medium M along a conveying path Q from the roll R to the discharge slot 31. The conveying path Q extends from the top of the roll R to the discharge slot 31 while passing through a printing position P1 and a cutting position P2 (see FIG. 7). The printing position P1 is the position at which the printing medium M is interposed between the printing unit 5 and the platen roller 61. The cutting position P2 is the position at which the printing medium M is cut by a fixed blade 81 and a movable blade 82 of the cutting unit 8 described later. In FIG. 7, the printing position P1 and cutting position P2 specify positions along the conveying direction D. The conveying direction D varies by position along the conveying path Q. Specifically, the conveying direction D is substantially forward on the downstream side of the printing position P1 and is substantially diagonally downward and forward on the upstream side of the printing position P1.

The cutting unit 8 is positioned downstream (in front) of the printing unit 5 in the conveying direction for cutting off a printed medium piece P from the continuous printing medium M. The cutting unit 8 includes a fixed blade 81, a movable blade 82, and a cutting motor 83 disposed inside the case 2. The blade edge of the fixed blade 81 is positioned slightly forward of the front side of the platen roller 61 in the front-rear direction. The movable blade 82 is disposed downward of and is separated from the fixed blade 81. The movable blade 82 can pivot relative to the fixed blade 81. When the movable blade 82 is pivoted upward, the edge of the movable blade 82 contacts the edge of the fixed blade 81 from the front. The cutting unit 8 pivots the movable blade 82 in response to the rotational drive of the cutting motor 83. The cutting motor 83 is a stepping motor, for example. When the movable blade 82 is pivoted, the fixed blade 81 and movable blade 82 cut the printing medium M through the thickness direction (up-down direction) along the width direction W. In the following description, the portion of the printing medium M cut off by the cutting unit 8 will be called the "printed medium piece P."

The guide member 10 is a plate-shaped member that is elongated in the left-right direction. The guide member 10 guides the printed medium piece P discharged from the case 2 through the discharge slot 31. The guide member 10 is provided at least within a region K2 within the extended range of the discharge slot 31. The region K2 is a region in the width direction W of at least a part of the printing medium M through which at least the part of the printing medium M passes. More preferably, the guide member 10 extends along an entire region K1 between the left and right ends of the discharge slot 31, as is the guide member 10 of the present embodiment shown in FIG. 1. In a left-side view, the guide member 10 is curved in an S-shape. The guide member 10 is rotatably supported about a shaft 11 provided at the upper edge of the guide member 10. The shaft 11 is disposed inside the rear surface on the front wall portion of the main case 3 above the discharge slot 31 and is oriented in the left-right direction. The guide member 10 extends through the discharge slot 31 in the front-rear direction, with the top edge of the guide member 10 disposed inside the case 2 and the bottom edge disposed outside the case 2. The guide member 10 is displaceable between an open position for allowing the printing medium M or printed medium piece P to pass through the discharge slot 31, and a closed position for blocking at least a portion of the discharge slot 31. The guide member 10 is in the closed position when the printing medium M or printed medium piece P is not present in the discharge slot 31. When the guide member 10 is in the closed position, a bottom surface 14 of the guide member 10 (see FIG. 7) contacts the bottom edge defining the discharge slot 31. When the printing medium M is being discharged through the discharge slot 31, the guide member 10 rotates clockwise in a right-side view from the closed position to the open position. The guide member 10 is provided with a restriction part 12 (see FIG. 7) that contacts and restricts the printed medium piece P from moving in a reverse conveying direction opposite the conveying direction D. The restriction part 12 is a protrusion that protrudes downward from the bottom surface 14 of the guide member 10. The restriction part 12 protrudes a distance from the bottom surface 14 greater than the thickness of the printed medium piece P. The restriction part 12 is disposed downstream in the conveying direction (forward) of the bottom edge defining the discharge slot 31, i.e., on the outside of the case 2.

Figure 3:
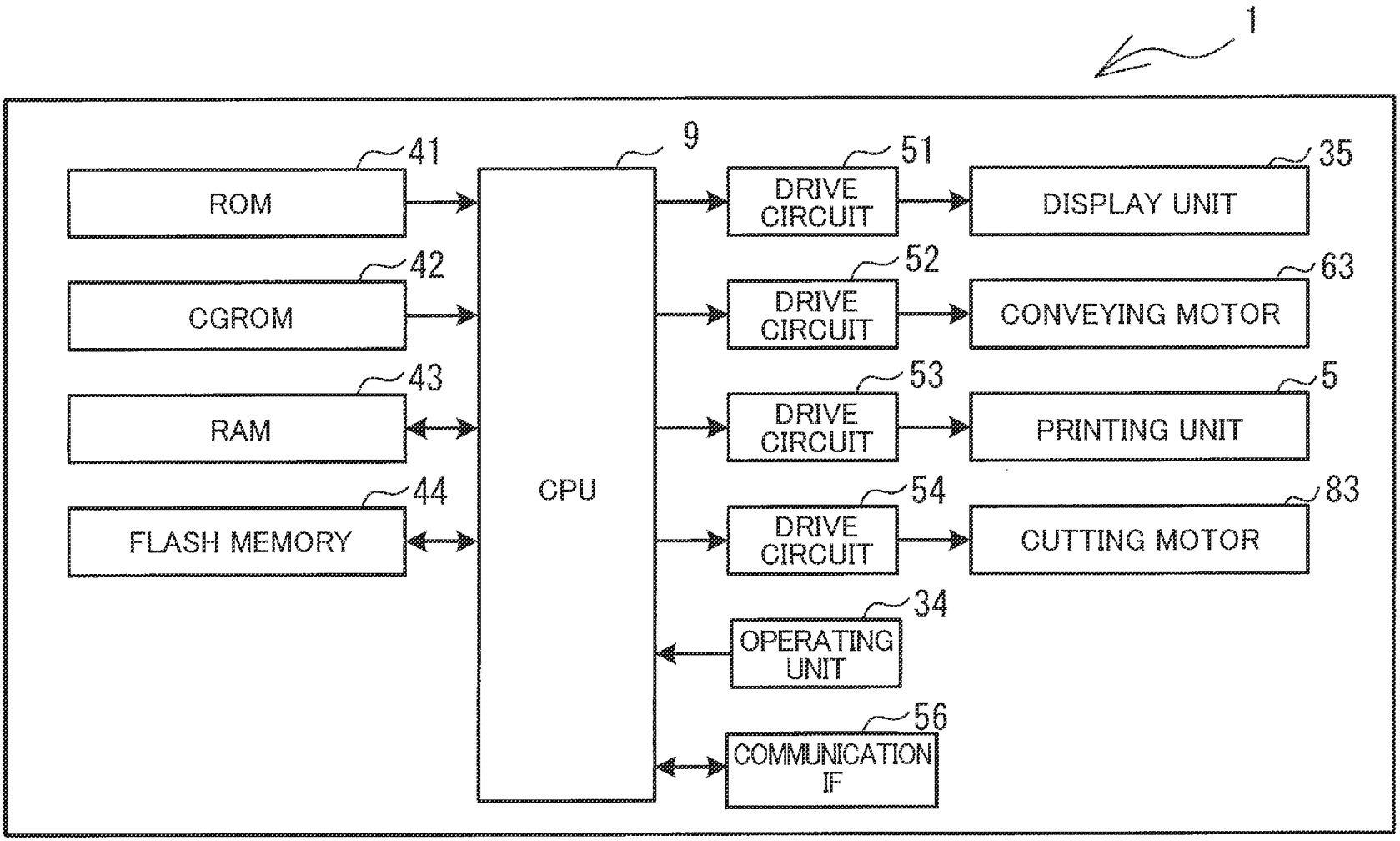
FIG. 3 is a block diagram illustrating an electrical configuration of the printer.

Next, the electrical configuration of the printer 1 will be described with reference to FIG. 3. The printer 1 is further provided with a CPU 9, a ROM 41, a CGROM 42, a RAM 43, a flash memory 44, drive circuits 51-54, and a communication interface 56. The ROM 41, CGROM 42, RAM 43, flash memory 44, drive circuits 51-54, operating unit 34, and communication interface 56 are electrically connected to the CPU 9. The CPU 9 performs overall control of the printer 1, including control of the printing unit 5, conveying unit 6, and cutting unit 8. The ROM 41 stores various parameters and the like required when the CPU 9 executes various programs. The CGROM 42 stores image data for characters printed on the printing medium M. The RAM 43 temporarily stores various information, such as results of computations performed by the CPU 9. The flash memory 44 is a non-volatile storage device that stores various programs executed by the CPU 9 and the like.

The drive circuit 51 is an electronic circuit for driving the display unit 35. The drive circuit 52 is an electronic circuit for driving the conveying motor 63. The drive circuit 53 is an electronic circuit for driving the printing unit 5. The drive circuit 54 is an electronic circuit for driving the cutting motor 83. The communication interface 56 enables the printer 1 to communicate with external devices.

Figure 4:
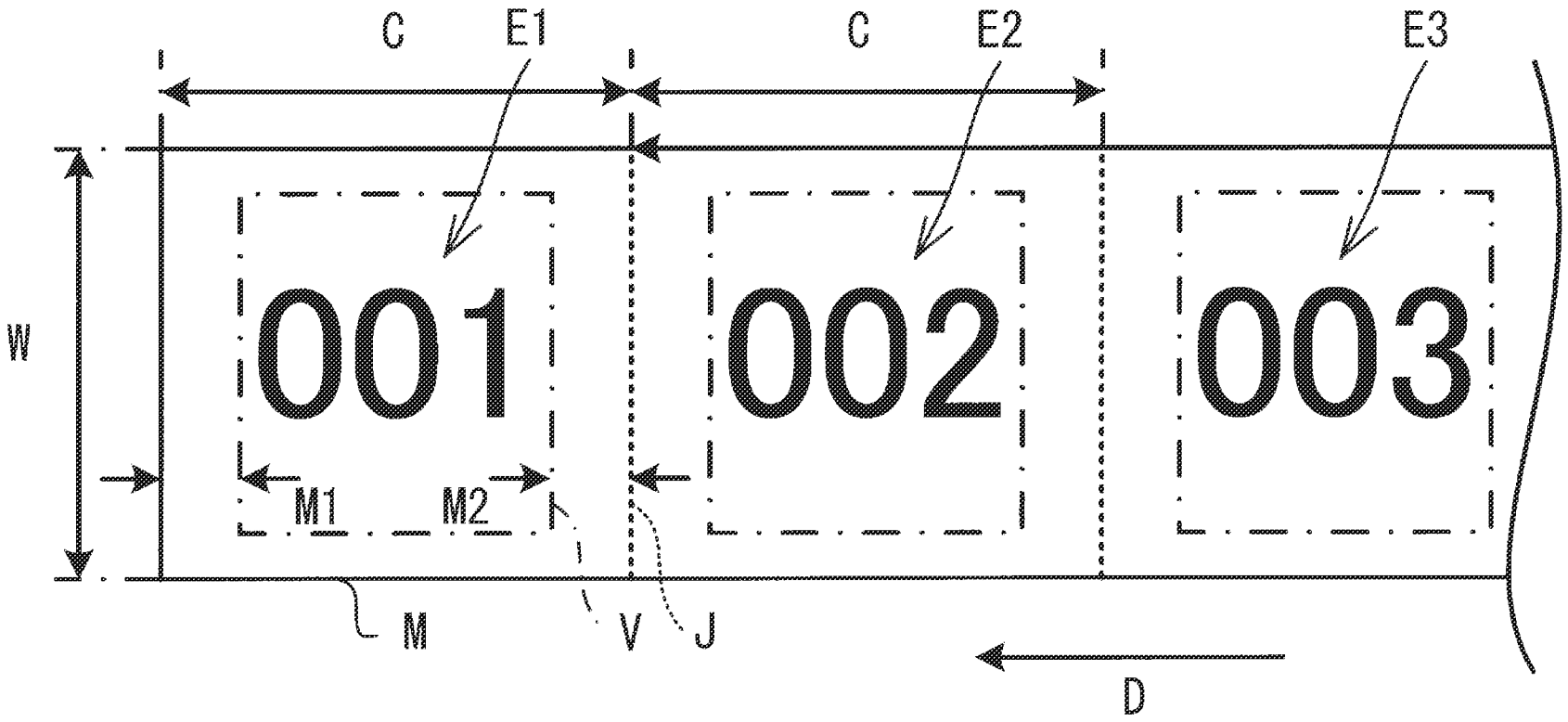
FIG. 4 is a view for description of sample images E1-E3 as examples printed on a basis of print data.

Next, a main process executed by the CPU 9 of the printer 1 will be described with reference to FIGS. 4 through 7. In the following example, sample images E1-E3 shown in FIG. 4 are printed continuously one by one. The main process is executed when the power for the printer 1 is turned on. Each of the images E1-E3 in this example represent consecutive three-digit numbers. In the following description, "step" in the step numbers provided for each process is abbreviated as "S". When the main process begins, the printing medium M is interposed between the platen roller 61 and the printing unit 5, with the leading edge of the printing medium M at a position downstream in the conveying direction (forward) of the platen roller 61 a distance corresponding to a previous feed amount described later.

Figure 5:
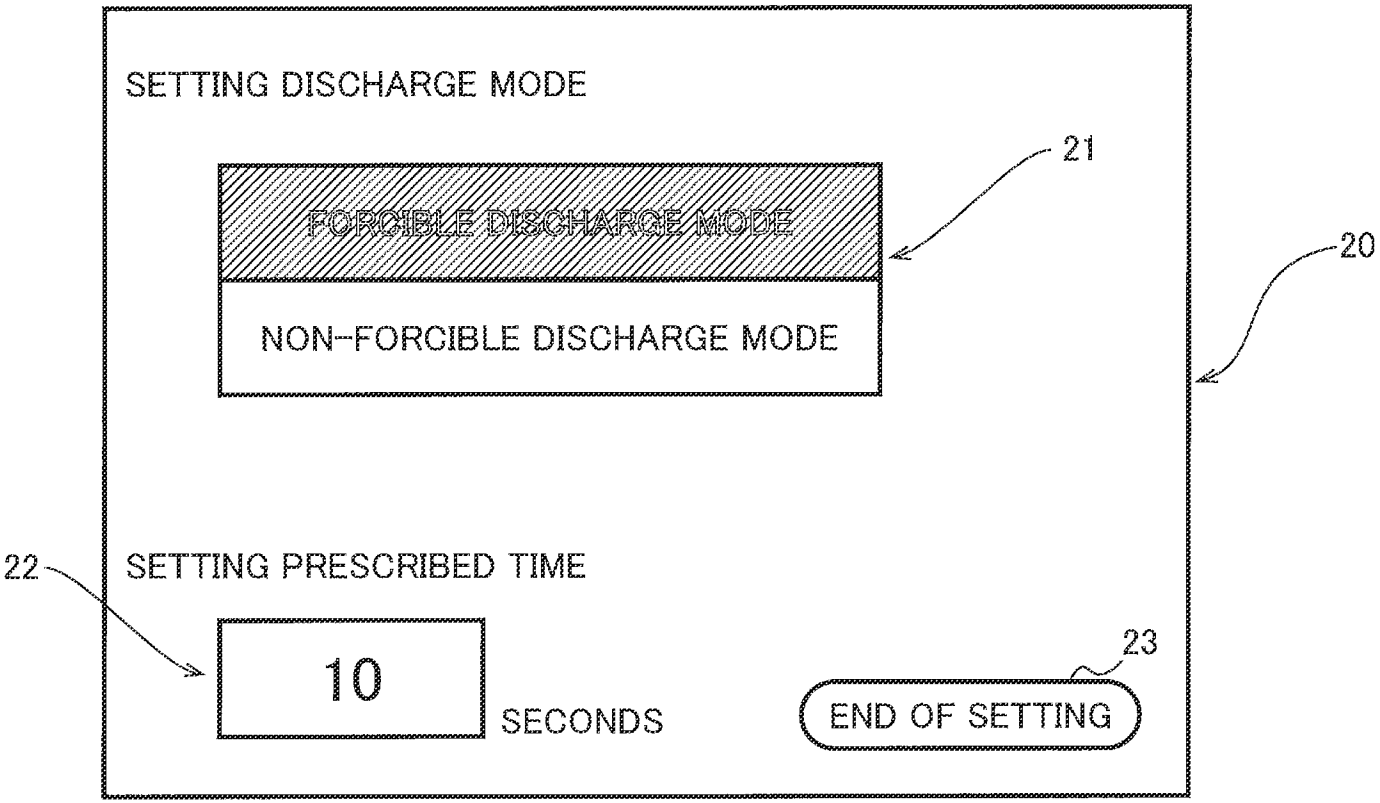
FIG. 5 is a view for description of settings screen.

As shown in FIG. 6, in S1 the CPU 9 determines whether a print command was detected. A print command instructs the execution of a printing process. The user can input a print command into the printer 1 through operations on the operating unit 34. Alternatively, the user can input a print command from a PC, portable terminal, or other external device that communicates with the printer 1 through the communication interface 56. While a print command has not been detected (S1: NO), in S21 the CPU 9 determines whether a discharge setting command was detected. A discharge setting command instructs CPU 9 to display the settings screen 20 to set discharge conditions for the printed medium piece P. While a discharge setting command has not been detected (S21: NO), the CPU 9 performs the process in S28 described later. To set a discharge condition for the printed medium piece P, the user operates the operating unit 34 to input a discharge setting command into the CPU 9. When a discharge setting command was detected (S21: YES), in S22 the CPU 9 displays a settings screen 20 shown in FIG. 5 on the display unit 35. The displayed settings screen 20 enables the user to set discharge conditions based on a discharge mode setting and a prescribed period of time setting stored in the flash memory 44. That is, the printer 1 according to the present embodiment can set a discharge mode for the printed medium piece P and a prescribed period of time as discharge conditions. the settings screen 20 has fields 21 and 22, and a button 23. The field 21 displays selectable discharge modes and highlights the currently set discharge mode. The printer 1 according to the present embodiment receives a setting for the discharge mode of the printed medium piece P from among a plurality of modes that include a forcible discharge mode and a non-forcible discharge mode. In the field 21, the currently set discharge mode is displayed in white text with a black background, while discharge modes that are not currently set are displayed in black text with a white background. Specifically, in FIG. 5, the background for the currently set mode is shown by hatching. In the example of FIG. 5, the forcible discharge mode is set as the current discharge mode. The field 22 displays a prescribed period of time to regulate the time interval for a printing process when the non-forcible discharge mode has been set as the current discharge mode. By selecting the button 23, the user inputs a command to quit settings of discharge conditions.

In S23 the CPU 9 determines whether a command to set the discharge mode was detected. To set a discharge mode, the user operates the operating unit 34 in order to select a desired mode from among the plurality of displayed modes, and subsequently inputs a command to set the discharge mode. When a command to set a discharge mode was detected (S23: YES), in S24 the CPU 9 sets the discharge mode based on the command and stores the specified discharge mode in the flash memory 44.

On the other hand, if a command to set the discharge mode was not detected (S23: NO) or after completing the setting in S24, in S25 the CPU 9 determines whether a command to set a prescribed period of time was detected. When the discharge mode is currently set to the non-forcible discharge mode, upon completion of a printing process in response to the current print command detected in S1, the printer 1 according to the present embodiment determines whether another print command was detected. If a subsequent print command exists, the printer 1 waits for a prescribed period of time to elapse after completion of the printing process in response to the current print command before performing a printing process in response to the next print command. For this purpose, the printer 1 accepts a setting for the prescribed period of time. When the discharge mode is set to the forcible discharge mode, the prescribed period of time is set to 0. To set the prescribed period of time, the user operates the operating unit 34 to input the prescribed period of time, and subsequently inputs a command to set the prescribed period of time. When a command to set the prescribed period of time was detected (S25: YES), in S26 the CPU 9 sets the prescribed period of time in response to the command and stores the time in the flash memory 44. If a command to set a prescribed period of time was not detected (S25: NO) or after completing the process in S26, in S27 the CPU 9 determines whether a command to quit settings for the discharge conditions was detected based on whether the button 23 was selected. If a command to quit settings was not detected (S27: NO), the CPU 9 returns to S23. When a command to quit settings was detected (S27: YES), the CPU 9 advances to S28 described later.

In S1 of this example, the user operates the operating unit 34 to input a continuous print command into the CPU 9 for performing a continuous print. The continuous print command in this example includes three print commands corresponding to the three images E1-E3. In addition to print data, each print command includes information representing lengths M1, M2, and C shown in FIG. 4. The length M1 is the length in the conveying direction D for a leading margin. The length M2 is the length in the conveying direction D for a trailing margin. The length C is the length in the conveying direction D for the printed medium piece P to be generated in response to the print command. The leading margin is the downstream margin in the conveying direction, and the trailing margin is the upstream margin in the conveying direction. The margins define a printing region V within the printed medium piece P in which an image is to be formed. The lengths M1 and M2 may be the same as or different from each other. When a plurality of print commands is inputted simultaneously, as with a continuous print command, the CPU 9 stores the plurality of print commands in the RAM 43, reads each print command one-at-a-time in the printing order, and performs a printing process based on each print command.

When a print command for printing the image E1 was detected (S1: YES), in S2 the CPU 9 calculates a reverse feed amount. The reverse feed amount is an amount corresponding to the previous feed amount and indicates the distance that the printing medium M must be conveyed in the reverse conveying direction after a cutting process is performed based on the previously detected print command (S7) and before a printing process is performed in response to the currently detected print command. The CPU 9 according to the present embodiment calculates the reverse feed amount according to Equation (1) described below. The previous feed amount is a value that was set in one of S11, S14, and S15 based on the previously detected print command and stored in the flash memory 44. If a previous print command was not detected, such as when the printer 1 was just started up, the previous feed amount is set to 0, for example. The reverse feed amount may be represented by the drive amount of the conveying motor or the length of the printing medium M in the conveying direction D.

Reverse feed amount=previous feed amount+length $D1$ in conveying direction $D$ between printing position $P1$ and cutting position $P2$−length $M1$ in conveying direction $D$ of leading margin set in print command (Equation 1)

As shown in FIG. 7(A), the reverse feed amount in the present embodiment is B1 when the previous feed amount was a first feed amount L1 described later, B2 when the previous feed amount was a second feed amount L2 described later, and B3 when the previous feed amount was 0. The reverse feed amount B2 is smaller than the reverse feed amount B1 and greater than the reverse feed amount B3.

In S3 the CPU 9 conveys the printing medium M in the reverse conveying direction by the reverse feed amount calculated in S2. Thus, in the case that the discharge mode is set to the forcible discharge mode, the CPU 9 drives the conveying unit 6 in the process of S3 to convey the printing medium M in the reverse conveying direction by the reverse feed amount B1 corresponding to the first feed amount L1 set in S11 after performing a forcible discharge process (S10) and prior to performing a printing process corresponding to the next print command (S5). After the process of S3 is performed, the printing medium M is slack and droops between the printing unit 5 and roll R, as illustrated in FIG. 7(B). At this time, the guide member 10 is in the closed position.

However, in a prescribed case when the discharge mode is set to the non-forcible discharge mode, the CPU 9 drives the conveying unit 6 to convey the printing medium M in the reverse conveying direction by the reverse feed amount B2 corresponding to the second feed amount L2 set in S14 after performing a push-out process (S13) and prior to performing the printing process corresponding to the next print command (S5).

In S4 the CPU 9 determines whether a prescribed period of time has elapsed after the previous printing process was completed. The CPU 9 continues to wait in S4 while the prescribed period of time has not elapsed (S4: NO). When the discharge mode is set to the forcible discharge mode, the process in S4 may be omitted since the prescribed period of time is set to 0, as described above. When the prescribed period of time after completion of the previous printing process has elapsed (S4: YES), in S5 the CPU 9 drives the printing unit 5 to perform a printing process to print an image on the printed medium piece P based on the print command detected in S1, as illustrated in FIG. 7(C). The printer 1 according to the present embodiment drives the conveying unit 6 in synchronization with the drive of the printing unit 5 in order to print on the printing medium M while conveying the printing medium M in the conveying direction D. During this printing process, the leading edge (front edge) of the printing medium M pushes the guide member 10 forward, causing the guide member 10 to rotate from the closed position to the open position. At this time, the image E1 in this example is printed on the printing medium M in the process of S5.

In S6 the CPU 9 resets and once again begins counting down the prescribed period of time. After completing the printing process based on the print command detected in S1 (S5), in S7 the CPU 9 drives the cutting unit 8 to perform a cutting process for cutting the printing medium M. Specifically, the CPU 9 drives the conveying unit 6 to convey the printing medium M in the conveying direction D until a cutting region J reaches the cutting position P2. As shown in FIG. 4, the cutting region J is the portion of the printing medium M upstream in the conveying direction by the length M2 from the upstream edge of the printing region V in the print command detected in S1. Hence, the CPU 9 conveys the printing medium M until the cutting region J reaches the cutting position P2 directly below the fixed blade 81. After conveying the cutting region J to the cutting position P2, the CPU 9 drives the cutting unit 8 to cut the printing medium M. Through this process, the portion of the printing medium M printed in the printing process of S5 is cut off from the printing medium M as a printed medium piece P, as illustrated in FIGS. 7(D) and 7(E). Specifically, the leading edge of the printed medium piece P is positioned forward of the discharge slot 31, but the printed medium piece P remains in the discharge slot 31.

In S8 the CPU 9 determines whether the discharge mode is currently set to the forcible discharge mode. If the forcible discharge mode is currently set (S8: YES), in S9 the CPU 9 references the RAM 43 to determine whether the print sequence includes another print command. Since a print command is stored in the RAM 43 for printing the image E2 after the image E1 in this example (S9: YES), in S15 the CPU 9 sets the previous feed amount to 0. Thus, when a next print command exists upon completing the printing process for the current print command detected in S1 (S9: YES), the CPU 9 does not perform the forcible discharge process between the printing process corresponding to the current print command and the printing process corresponding to the next print command, even when the discharge mode is set to the forcible discharge mode (S8: YES).

However, if a next print command does not exist (S9: NO), in S10 the CPU 9 performs the forcible discharge process. Specifically, after completing the cutting process based on the current print command detected in S1 (S7) and prior to performing a printing process based on the next print command (S5), the CPU 9 drives the conveying unit 6 to convey the printing medium M in the conveying direction D by the first feed amount L1. The first feed amount L1 is greater than or equal to a push-out distance based on a length D2 in the conveying direction D from the cutting position P2 to the discharge slot 31. The first feed amount L1 is stored in the flash memory 44, for example. After performing the process in S10, the leading edge of the printing medium M is positioned outside the case 2, as illustrated in FIG. 7(F). That is, the bottom surface on the leading-edge portion of the printing medium M contacts the bottom edge defining the discharge slot 31, while the top surface on the leading-edge portion of the printing medium M contacts the bottom edge of the restriction part 12 formed on the guide member 10. The leading-edge portion of the printing medium M pushes the printed medium piece P forward while being conveyed in the conveying direction D so that the printed medium piece P is discharged from the case 2 through the discharge slot 31 formed in the case 2. The printed medium piece P is guided by the guide member 10 to move diagonally downward and forward along the sloped front surface of the main case 3. In S11 the CPU 9 sets the previous feed amount to the first feed amount L1, which is the feed amount in the conveying direction D used for feeding the printing medium M in the forcible discharge process of S10.

When the discharge mode is set to the non-forcible discharge mode (S8: NO), the CPU 9 does not perform the forcible discharge process and in S12 determines whether the length C in the conveying direction D of the printed medium piece P generated in response to the print command acquired in S1 is greater than a threshold value. The threshold value is set with consideration for a retrievable length. The retrievable length is the minimum length of a printed medium piece P that can be retrieved from the discharge slot 31. Specifically, the retrievable length is a value set by adding a prescribed length (10 mm, for example) to the length D2 in the conveying direction D from the cutting position P2 to the discharge slot 31. The threshold value is stored in the flash memory 44, for example. When the length C is greater than the threshold value (S12: YES), in S15 the CPU 9 sets the previous feed amount to 0 without performing a push-out process described later. Through this process, the trailing edge of the printed medium piece P and the leading edge of the printing medium M are maintained at the cutting position P2. Owing to the length C of the printed medium piece P in the conveying direction D, the printed medium piece P remains in the discharge slot 31 without falling out therefrom. When the length C of the printed medium piece P in the conveying direction D is less than or equal to the threshold value (S12: NO), in S13 the CPU 9 performs a push-out process, even though the discharge mode is set to the non-forcible discharge mode. Specifically, after completing the cutting process for the print command detected in S1 (S7) and prior to performing a printing process based on a subsequent print command, the CPU 9 drives the conveying unit 6 to convey the printing medium M in the conveying direction D by the second feed amount L2. The second feed amount L2 is greater than or equal to a value obtained by subtracting the length C from the threshold value used in S12 and less than or equal to the first feed amount L1. In the present embodiment, the second feed amount L2 is smaller than the first feed amount L1. The second feed amount L2 is stored in the flash memory 44, for example. Through the process of S13, the leading edge of the printing medium M is moved downstream in the conveying direction from the cutting position P2 and pushes the printed medium piece P in the conveying direction D, as illustrated in FIG. 7(G). In S14 the CPU 9 sets the previous feed amount to the second feed amount L2.

After completing any of the processes in S11, S14, and S15, in S28 the CPU 9 determines whether the power to the printer 1 has been turned off. If the power to the printer 1 is not off (S28: NO), the CPU 9 returns to S1. In this example, the CPU 9 sequentially executes a process based on the print command for printing the image E2 and a process based on the print command for printing the image E3. If the CPU 9 determines in S28 that the power is off (S28: YES), the CPU 9 ends the main process.

In the present embodiment described above, the printer 1, printing unit 5, conveying unit 6, cutting unit 8, case 2, and CPU 9 are respective examples of the printer, printing unit, conveying unit, cutting unit, case, and control unit of the present invention. The processes in S23 and S24 of FIG. 6 are examples of the forcible discharge process of the present invention. The process in S13 is an example of the push-out process of the present invention. The process in S4 is an example of the print control process of the present invention. The process in S3 is an example of the reverse conveying process of the present invention.

The printer 1 according to the present embodiment described above is provided with the printing unit 5, conveying unit 6, cutting unit 8, case 2, and CPU 9. The printing unit 5 prints images on the continuous printing medium M. The conveying unit 6 conveys the printing medium M in the conveying direction D. The cutting unit 8 is positioned downstream of the printing unit 5 in the conveying direction and configured to cut off the printed medium piece P from the continuous printing medium M. The case 2 accommodates the printing unit 5, conveying unit 6, and cutting unit 8. The CPU 9 controls the printing unit 5, conveying unit 6, and cutting unit 8. The CPU 9 performs a setting process (S23, S24) for receiving a setting for the discharge mode of a printed medium piece P from among a plurality of modes that include a forcible discharge mode and a non-forcible discharge mode; a printing process (S5) for driving the printing unit 5 to print an image on the printing medium M in response to a print command; and a cutting process (S7) for driving the cutting unit 8 to cut off the printed medium piece P from the continuous printing medium M after completing a printing process in response to a print command. When the discharge mode is currently set to the forcible discharge mode (S8: YES), after completing the cutting process based on the current print command and prior to performing a printing process based on the next print command, the CPU 9 performs a forcible discharge process (S10). In the forcible discharge process, the CPU 9 drives the conveying unit 6 to convey the printing medium M in the conveying direction D by the first feed amount L1 so that the leading edge of the printing medium M pushes the printed medium piece P, discharging the printed medium piece P from the case 2 through the discharge slot 31 formed in the case 2. If the discharge mode is currently set to the non-forcible discharge mode (S8: NO), the CPU 9 does not perform the forcible discharge process (but instead performs the process in S13-S14 or S15). Thus, the printer 1 can switch between executing or not executing the forcible discharge process based on the currently set discharge mode. Therefore, the printer 1 can make retrieving the printed medium piece P more user-friendly than a conventional printer, which cannot set an option for conveying or not conveying the printing medium M in the conveying direction D to push the printed medium piece P out of the case 2 through the discharge slot 31.

When the length C of the printed medium piece P in the conveying direction D is less than or equal to the threshold value (S12: NO), the CPU 9 performs the push-out process (S13), even though the discharge mode is set to the non-forcible discharge mode (S8: NO). In the push-out process, the CPU 9 drives the conveying unit 6 to convey the printing medium M in the conveying direction D by the second feed amount L2, which is less than or equal to the first feed amount L1, after completing the cutting process in response to one print command and prior to performing the printing process in response to the next print command. Through this process, the leading edge of the printing medium M pushes the printed medium piece P in the conveying direction D. Accordingly, the printer 1 can avoid situations in which the printed medium piece P is difficult to retrieve from the discharge slot 31 because the length C of the printed medium piece P in the conveying direction D is too short.

Upon completion of a printing process based on one print command, if another print command exists (S9: YES) while the discharge mode is set to the non-forcible discharge mode, the CPU 9 performs a printing process (S5) based on the next print command once a prescribed period of time has elapsed (S4: YES) after the printing process based on the current print command is complete. If the printer 1 performs the printing process in response to the next print command continuously after the printing process for the current print command without executing the delay process of S4, the printing medium M conveyed in the conveying direction D during the printing process in response to the next print command would push the printed medium piece P through the discharge slot 31 so that the printed medium piece P drops out of the case 2, despite the discharge mode being set to the non-forcible discharge mode. However, the printer 1 according to the present embodiment performs the process in S4. Thus, when executing printing processes continuously based on a plurality of print commands, after performing one printing process (S5), the printer 1 waits for the prescribed period of time to elapse before performing the next printing process on the condition that the discharge mode is set to the non-forcible discharge mode. Accordingly, the printer 1 can retain the printed medium piece P in the discharge slot 31 for the prescribed period of time. Further, since the printer 1 receives a setting for the prescribed period of time (S26), the printer 1 according to the present embodiment is more user-friendly than a printer that does not accept a setting for the prescribed period of time.

If a next print command exists upon completion of a printing process for the current print command, in some cases performing the forcible discharge process is unnecessary because the printed medium piece P created in response to the current print command is pushed downstream in the conveying direction during the printing process for the next print command. Thus, when a next print command exists upon completing a printing process for the current print command (S9: YES), the printer 1 does not perform the forcible discharge process (S15) after the printing process corresponding to the first print command and before the printing process corresponding to the next print command, even when the discharge mode is set to the forcible discharge mode (S8: YES). Thus, the printer 1 according to the present embodiment requires less printing time than if the printer 1 were to follow the discharge mode setting and perform the forcible discharge process upon completion of a printing process for a current print command every time another print command existed.

The conveying unit 6 provided in the printer 1 can convey the printing medium M both in the conveying direction D and in a reverse conveying direction opposite the conveying direction D. If the discharge mode is currently set to the forcible discharge mode (S8: YES), the CPU 9 performs a reverse conveying process (S2, S3) after performing the forcible discharge process (S10) and before performing the printing process for the next print command. In the reverse conveying process, the CPU 9 drives the conveying unit 6 to convey the printing medium M in the reverse conveying direction by the reverse feed amount B1 corresponding to the first feed amount L1. In this way, the printer 1 avoids situations in which the margin in the conveying direction D of the printed medium piece P created in the printing process corresponding to the next print command is greater than the margin set in the print command due to execution of the forcible discharge process.

The CPU 9 calculates the reverse feed amount based on the length M1 of the leading margin in the conveying direction D set in the next print command and the first feed amount L1 (S2). The CPU 9 executes the reverse conveying process (S3) after acquiring the next print command in S1 and before beginning the printing process corresponding to the next print command (S5). The printer 1 can perform the reverse conveying process with consideration for the length M1 of the leading margin in the conveying direction D set in the next print command. In this way, the printer 1 can achieve a simpler process than when the printer 1 performs a reverse conveying process without considering the length M1 of the leading margin following the printing process for one print command and subsequently performs a conveying process corresponding to the length M1 of the leading margin separately from the reverse conveying process of S3.

The printer 1 is provided with the guide member 10 that is displaceable between an open position and a closed position. In the open position, the guide member 10 allows passage of the printing medium M or printed medium piece P through the discharge slot 31. In the closed position, the guide member 10 blocks at least part of the discharge slot 31. The guide member 10 is in the closed position when the printing medium M or printed medium piece P is not present in the discharge slot 31. Owing to the guide member 10, the printer 1 can suppress dust and other foreign matter from entering the case 2.

The guide member 10 is provided with the restriction part 12 that contacts and restricts the printed medium piece P from moving in the reverse conveying direction opposite the conveying direction D. As shown in the enlarged view in FIG. 7(F), the printed medium piece P remains near the discharge slot 31 in a state overlapping the printing medium M following the forcible discharge process. Here, even if the printed medium piece P were to move in the reverse conveying direction together with the printing medium M during a reverse conveying process, the trailing edge of the printed medium piece P would contact the restriction part 12 during the course of movement. Accordingly, the printer 1 can restrict the printed medium piece P from moving together with the printing medium M in the reverse conveying direction. Thus, even when the printed medium piece P remains near the discharge slot 31 in a state overlapping the printing medium M following the forcible discharge process, the printer 1 can ensure that the printed medium piece P falls out of the case 2 through the discharge slot 31 during the reverse conveying process.

While the invention has been described in detail with reference to specific embodiments thereof, it would be apparent to those skilled in the art that many modifications and variations may be made therein without departing from the spirit of the invention, the scope of which is defined by the attached claims.

The shape of the case 2 may be modified as needed. For example, the case 2 may have a rectangular parallelepiped shape that is elongated in the up-down direction, and the discharge slot 31 may be formed on the front surface of the rectangular parallelepiped shaped case. The configuration of the cutting unit 8 may be modified as needed. For example, the moveable blade that is pivotable relative to the fixed blade may be disposed above the conveying path Q. The guide member 10 may also be omitted from the printer 1. Alternatively, the guide member 10 may extend only in the region K2 through which passes a printing medium M having the smallest width supported by the printer 1. The region K2 may be a region along the width direction W that includes either edge of the entire region K1 or a region in the width direction W that includes the center of the entire region K1. The top edge of the guide member 10 may be disposed outside the case 2. The guide member 10 also need not include the restriction part 12. For example, the guide member 10 may be formed with a larger coefficient of friction than the member contacted by the printing medium M so that the frictional force produced by the part contacting the printed medium piece P restricts the printed medium piece P from moving in the reverse conveying direction. The shapes, arrangements, sizes, and the like of the guide member 10 and restriction part 12 may be otherwise modified as needed.

The program that includes instructions for executing the main process shown in FIG. 6 may be stored in a storage device of the printer 1 until executed by the CPU 9. Hence, any of the method for acquiring the program, the acquisition route, and the device storing the program may be modified as needed. The programs executed by the CPU 9 may be received from another device through a cable or wireless communication or may be stored in a storage device, such as flash memory. Other devices may include a PC, and a server connected over a network, for example.

While the steps in the main process performed on the printer 1 are executed by the CPU 9, all or some of these steps may be executed by another electronic device, such as an application-specific integrated circuit (ASIC). Processing of the steps in the main process may be distributed among a plurality of electronic devices, such as a plurality of CPUs. Steps in the main process described above may be omitted, additional steps may be added, and the order of the steps may be modified as needed. The scope of the present invention includes a mode in which an operating system (OS) or the like running on the printer 1 performs all or part of the main process based on commands from the CPU 9. For example, the following modifications may be made to the main process.

The types of discharge modes that can be set on the printer 1 may include other discharge modes, provided that the forcible discharge mode and non-forcible discharge mode are also included. Directly after the forcible discharge process (between S10 and S11, for example), the printer 1 may convey the printing medium M in the reverse conveying direction until the leading edge of the printing medium M is at the cutting position P2 and, in place of the process in S2 and S3, may perform a process to convey the printing medium M in the reverse conveying direction from the cutting position P2 until the leading edge of the printing medium M is positioned downstream from the printing position P1 in the conveying direction by the leading margin M1. The reverse conveying process performed after the printing process for one print command and before the printing process for the next print command for conveying the printing medium M in the reverse conveying direction may be omitted. The method of calculating the reverse feed amount may be modified as needed. For example, the reverse feed amount need not be a value corresponding to the length of a margin in the conveying direction D specified in the print command.

When the discharge mode is set to the forcible discharge mode (S8: YES), the printer 1 may perform the forcible discharge process regardless of whether a next print command exists. When the discharge mode is set to the non-forcible discharge mode (S8: NO), the printer 1 need not perform the push-out process regardless of the length C of the printed medium piece P in the conveying direction D.

The printer of the present invention may be configured in various other ways by suitably combining features of the printer disclosed in the embodiment and its variations.

What is claimed is:

1. A printer comprising:

a printing unit configured to print images on a continuous printing medium;

a conveying unit configured to convey the continuous printing medium in a conveying direction;

a cutting unit positioned downstream of the printing unit in the conveying direction and configured to cut off a printed medium piece from the continuous printing medium;

a casing configured to accommodate the printing unit, the conveying unit and the cutting unit therein, the casing being formed with a discharging opening; and a controller configured to control the printing unit, the conveying unit and the cutting unit, the controller being configured to perform:

receiving a setting for a discharge mode of the printed medium piece, the setting being selected from among a plurality of modes which includes a forcible discharge mode and a non-forcible discharge mode;

driving the printing unit to print an image on the continuous printing medium in response to a print command;

driving the cutting unit to cut off the printed medium piece from the continuous printing medium after completing the printing in response to the print command; and in a case where the discharge mode is currently set to the forcible discharge mode, after completing the cutting in response to the print command and prior to performing the printing in response to a next print command, forcibly discharging the printed medium piece from the casing through the discharging opening, a leading edge of the continuous printing medium being conveyed by a first feed amount in the conveying direction by driving the conveying unit such that the printed medium piece is pushed by the leading edge of the continuous printing medium; and in a case where the discharge mode is currently set to the non-forcible discharge mode, non-forcibly discharging the printed medium piece from the casing through the discharging opening.

2. The printer according to claim 1, wherein, in a case where the discharge mode is set to the non-forcible discharge mode, when a length of the printed medium piece in the conveying direction is less than or equal to a threshold value, the controller is configured to further perform pushing out the printed medium piece in the conveying direction by the leading edge of the continuous printing medium, the leading edge of the continuous printing medium being conveyed by a second feed amount in the conveying direction by driving the conveying unit such that the printed medium piece is pushed by the leading edge of the continuous printing medium after completing the cutting in response to the print command and prior to performing the printing in response to the next printing command.

3. The printer according to claim 1, wherein, in a case where the discharge mode is set to the non-forcible discharge mode, after completion of the printing in response to the print command, if the next print command exists, the controller is configured to further perform the printing in response to the next print command once a prescribed period of time has elapsed after the printing in response to the print command is complete.

4. The printer according to claim 1, wherein, even though the discharge mode is set to the forcible discharge mode, when the next print command exists after completing the printing for the print command, the controller is configured not to perform forcible discharging after the printing in response to the print command and before the printing in response to the next print command.

5. The printer according to claim 1, wherein the conveying unit is configured to convey the continuous printing medium both in the conveying direction and in a reverse conveying direction opposite the conveying direction, wherein, in a case where the discharge mode is set to the forcible discharge mode, the controller is configured to further perform reverse conveying the continuous printing medium in the reverse conveying direction by a reverse feed amount according to the first feed amount by driving the conveying unit after performing the forcible discharging and before performing the printing in response to the next print command.

6. The printer according to claim 5, wherein the reverse feed amount corresponds to a length of a leading margin in the conveying direction set in the next print command and the first feed amount, and wherein the controller is configured to perform the reverse conveying the continuous printing medium in the reverse conveying direction after acquiring the next print command and before beginning the printing in response to the next print command.

7. The printer according to claim 5, further comprising a guide member displaceable between an open position and a closed position, the guide member allowing passage of the continuous printing medium or the printed medium piece through the discharge opening when the guide member is in the open position, the guide member blocking at least part of the discharge opening when the guide member is in the closed position, wherein the guide member is located at the closed position when the continuous printing medium or the printed medium piece is not present in the discharge opening.

8. The printer according to claim 7, wherein the guide member includes a restriction part restricting the printed medium piece from moving in the reverse conveying direction opposite the conveying direction by contacting the continuous printing medium.

* * * * *